US009934703B2

(12) United States Patent
Quintin

(10) Patent No.: US 9,934,703 B2
(45) Date of Patent: Apr. 3, 2018

(54) LABEL FOR DECORATING A BOTTLE, BOTTLE AND METHOD OF MANUFACTURE OF SUCH A LABEL

(71) Applicant: CEVENPACK, Saint-Hyppolyte du Fort (FR)

(72) Inventor: Jean-David Quintin, Saint-Hyppolyte du Fort (FR)

(73) Assignee: CEVENPACK, Saint-Hyppolyte du Fort (FR)

( * ) Notice: Subject to any disclaimer, the term of this patent is extended or adjusted under 35 U.S.C. 154(b) by 75 days.

(21) Appl. No.: 15/031,143

(22) PCT Filed: Oct. 24, 2014

(86) PCT No.: PCT/FR2014/052721

§ 371 (c)(1),
(2) Date: Apr. 21, 2016

(87) PCT Pub. No.: WO2015/059431

PCT Pub. Date: Apr. 30, 2015

(65) Prior Publication Data

US 2016/0253929 A1 Sep. 1, 2016

(30) Foreign Application Priority Data

Oct. 24, 2013 (FR) ..... 13 60410

(51) Int. Cl.
*G09F 3/10* (2006.01)
*G09F 3/02* (2006.01)
(Continued)

(52) U.S. Cl.
CPC ..... *G09F 3/02* (2013.01); *B44C 1/105* (2013.01); *B44C 3/025* (2013.01); *B65D 1/02* (2013.01);
(Continued)

(58) Field of Classification Search
CPC ..... G09F 3/10; G09F 3/02; G09F 2003/0272; Y10T 428/14; Y10T 428/1476
(Continued)

(56) References Cited

U.S. PATENT DOCUMENTS 2,890,449 A * 6/1959 Stavis ..... G01S 1/02 342/399
5,512,122 A * 4/1996 Sokyrka ..... B41M 3/16 156/275.5
(Continued)

FOREIGN PATENT DOCUMENTS

DE 42 11 494 A1 10/1993
DE 93 17 987 U1 1/1994
(Continued)

OTHER PUBLICATIONS

International Search Report, dated Feb. 3, 2015, from corresponding PCT Application.

*Primary Examiner* — Shin H Kim
(74) *Attorney, Agent, or Firm* — PatShegen IP

(57) ABSTRACT

The self-adhesive label (10) produced in relief in order visually and/or in a tactile manner to simulate decorative etching of the material of a container or a decorative seal or stamp applied to the container, includes: a layer of adhesive (105); a sheet of flexible plastic (110), one face of which is entirely covered by the layer of adhesive; and an extra thickness (120) formed on the opposite face of the sheet of flexible plastic to the layer of adhesive. The extra thickness includes a flexible plastic and covers the edge (115) of the sheet to form a decorative design simulating an engraved relief. The peripheries of the extra thickness and of the sheet of plastic are cut jointly, the cut edge of the extra thickness thus coming as a continuation of the cut edge of the sheet up to the lower surface of the sheet of flexible plastic.

24 Claims, 9 Drawing Sheets

(51) Int. Cl.

| | |
|---|---|
| ***B44C 1/10*** | (2006.01) |
| ***B44C 3/02*** | (2006.01) |
| ***B65D 1/02*** | (2006.01) |
| ***B65D 23/08*** | (2006.01) |

(52) U.S. Cl.
CPC ..... *B65D 23/085* (2013.01); *G09F 3/10* (2013.01); *G09F 2003/0208* (2013.01); *G09F 2003/0273* (2013.01)

(58) Field of Classification Search
USPC ..... 40/638
See application file for complete search history.

(56) References Cited

U.S. PATENT DOCUMENTS 5,857,275 A * 1/1999 Deal ..... G09F 3/10 40/310
5,982,284 A * 11/1999 Baldwin ..... G06K 19/0672 29/829
6,270,871 B1 * 8/2001 Scholz ..... C09J 7/0203 283/101
6,760,989 B2 * 7/2004 Peterson ..... G09F 7/00 40/593
6,857,211 B2 * 2/2005 Grasso ..... G09F 3/10 40/310
7,185,453 B2 * 3/2007 Spear ..... G09F 3/10 40/616
8,302,337 B2 * 11/2012 Savagian ..... B32B 7/06 40/615
2003/0150148 A1 * 8/2003 Spear ..... G09F 3/02 40/638
2003/0221347 A1 * 12/2003 Peterson ..... G09F 7/00 40/593
2004/0111941 A1 * 6/2004 Spear ..... G09F 3/10 40/638
2005/0160637 A1 * 7/2005 Hesse ..... G09F 13/20 40/124.5
2011/0296727 A1 * 12/2011 Savagian ..... B32B 7/06 40/594
2015/0279245 A1 * 10/2015 Siekkinen ..... B32B 27/08 40/638

FOREIGN PATENT DOCUMENTS

| | | | |
|---|---|---|---|
| FR | 1 602 234 | A | 10/1970 |
| FR | 2 857 293 | A1 | 1/2005 |
| JP | 3153049 | U | 8/2009 |
| WO | 98/33660 | A1 | 8/1998 |

* cited by examiner

LABEL FOR DECORATING A BOTTLE, BOTTLE AND METHOD OF MANUFACTURE OF SUCH A LABEL

TECHNICAL FIELD OF THE INVENTION

The present invention envisages a label for decorating a bottle, bottle and method of manufacture of such a label. It applies to enhancing a packaging, e.g. a perfume bottle, or a glass bottle, notably for drinks and in particular for wine or spirits.

STATE OF THE ART

Glass moldings and engravings for bottles are known that make it possible to incorporate a customization in 3D within the wall of these bottles. However, these moldings or engravings are costly and can cause mechanical weaknesses in certain areas of the bottle.

Wax seals are also known, which are placed on bottles to give them a more elegant look. However, these seals are costly to manufacture, hard to replicate and affix on the bottles.

Document DE9317987 is known, which describes a paper label having a thickened edge to protect its surface from wear. However, this type of label does not look to be made from the same material as the bottle and therefore does not enhance the bottle.

Document WO 98/33660 is known, which describes a label with a pseudo-3D display thanks to optical lenses or a hologram. However, this type of label does not look to be made from the same material as the bottle and therefore does not enhance the bottle.

Document DE 42 14 294 is known, which describes a label fitted with an insert for protection from shocks. However, this type of label does not look to be made from a single material and even less from the same material as the bottle, and therefore does not enhance the bottle.

SUBJECT OF THE INVENTION

The present invention aims to remedy all or part of these drawbacks.

To this end, according to a first aspect, the present invention envisages a self-adhesive label in relief to simulate visually and/or tactilely a decorative molding of the material of a container or a decorative seal affixed to the container, comprising:

- a layer of adhesive;
- a flexible plastic sheet, one surface of which is entirely covered by the layer of adhesive; and
- an extra thickness formed on the surface of the flexible plastic sheet opposite the layer of adhesive, the extra thickness comprising a flexible plastic material and covering the edge of the sheet to form a decorative design simulating an engraved relief or an edge of a seal, the peripheries of the extra thickness and of the sheet of plastic being cut jointly, the cut edge of the extra thickness thus coming as a continuation of the cut edge of the sheet up to the lower surface of the flexible plastic sheet.

Thanks to these provisions, the extra thickness of plastic material hides the edge of the plastic sheet and therefore prevents:

- any means of detecting that the label is made of several layers;

- any means of detecting that the label is affixed by gluing onto the container;
- any reflection that would make it possible to detect, by eye, that this is a label rather than a glass molding, an engraving in the glass or a wax seal; and
- any overspill of the extra thickness or of the sheet that would make it possible to detect, by touch, that this is a label rather than a glass molding, an engraving in the glass or a wax seal.

Once glued, the label gives the impression of being incorporated into the material of the carrier, e.g. a bottle, or of forming a wax seal placed by melting wax.

The extra thickness that follows the outline of the label creates an esthetic barrier and has three functions:

- making the label's edges invisible once the label has been pressed up against the glass of a bottle;
- partitioning two different materials, firstly the bottle's glass and secondly the synthetic material of the label, to prevent the consumer from detecting their different aspect and brightness; and
- strengthening the label against tears or plastic deformations.

The label that is the subject of the present invention is easy to affix by hand or using a standard labeler. Utilizing it makes it possible to customize small, medium and large quantities of bottles at a low cost, while avoiding the constraints of glassmakers, such as capital investment for the mold, a large minimum quantity, required storage, blocked funds and engraving on glass, with the mechanical weaknesses it causes.

Preferably, the angle of the jointly-cut edges of the extra thickness and the flexible plastic sheet to the lower surface of the flexible plastic sheet is 90 degrees.

In some embodiments, the layer of adhesive, the flexible plastic sheet and the extra thickness of flexible plastic material are, at least in part, transparent. The label thus looks as if it is made of the glass of the bottle that bears it.

In some embodiments, the extra thickness does not cover the entire flexible plastic sheet. The label that is the subject of the present invention thus has a relief similar to that produced with a glassmakers molding or by melting a wax seal.

In some embodiments, the flexible plastic sheet comprises translucent polypropylene. This polypropylene makes the label translucent once it has been applied to the glass bottle, thanks to the absence of traces of adhesive.

In some embodiments, the label that is the subject of the present invention comprises a removable carrier comprising a PET ridge laminated onto glassine. The adhesive is thus particularly smooth at the time the label is affixed to the bottle, which prevents the formation of irregularities of bubbles damaging to the label's appearance.

In some embodiments, the extra thickness comprises an acrylic 3D varnish polymerizable by ultraviolet rays. Applied to a glass bottle, this label makes it possible to imitate the appearance and feel of a bottle engraved by a glassmaker. Tinted 3D printing, made with a mixture of varnish and, possibly, pigments, makes it possible to match the color of the glass of a bottle.

In some embodiments, the extra thickness is formed by digital inkjet printing. For example, this printing is produced thanks to a UV varnish, with or without a tinted undercoat. Thanks to these provisions, small and medium-size runs of labels can be handled and tooling costs sharply reduced. For labels designed to customize clear glass bottles, during the application by inkjet of the varnish in 3D, a complete absence of air bubbles is noted, giving at the end a completely translucent varnish, unlike a screen-printed varnish that may become laden with bubbles and lose its transparency.

In some embodiments, the extra thickness is poured then hardened.

In some embodiments, the sheet bears a "resin stop" stripe printed with an aqueous or UV varnish configured to repel a predefined flexible plastic material, the extra thickness being formed with said predefined flexible plastic material.

Thanks to each of these provisions, the extra thickness takes the shape of a drop of thick liquid, as does a wax or glass seal deposited by melting.

In some embodiments, the extra thickness comprises polyurethane resin mixed with isocyanate hardener. The extra thickness is thus transparent and hardened after being made in the shape of a drop of liquid. Thus, by forming a magnifier, the upper and side portion leaves exactly the same color visible over the whole surface of the upper and side portion as the lower portion it covers. To the inventors knowledge, it is impossible to obtain embossing of this quality either in terms of height or look by any other method.

In some embodiments, the flexible plastic sheet comprises metallized polyester.

In some embodiments, the flexible plastic sheet bears a printed solid area with a margin.

Thanks to each of these provisions, the forming of a metallized design, gold- or silver-colored for example, is achieved in a label resembling a wax seal, thanks to the solid area of ink, thanks to the appearance of the metallized polyester visible in the margins.

In some embodiments, the flexible plastic sheet is made of PVC, polyolefin or transparent PP. A label with the aspect of a glass seal or molding is thus realized.

In some embodiments, the extra thickness forms a 3D border at least 1.5 mm wide and at least 250 μm thick, which follows the outline of the label.

In some embodiments, the extra thickness is formed from a first tinted layer of transparent varnish and pigments, and from a second layer of the same varnish, transparent or tinted, superimposed on the first tinted layer.

In some embodiments, the flexible plastic sheet carries printing of two screen-printed solid areas of matte ink, superimposed on each other forming a totally opaque color background. A label with the aspect of a wax seal is thus obtained.

The advantages of the label utilizing these last embodiments comprise, compared to a conventional wax seal:

- this label eliminates the painstaking set up for a genuine "wax seal", where the wax has to be softened, poured onto the object, the wax stamped and engraved with a more or less successful rendering, all with very low yields;
- this label can be delivered on backing sheets, be removed from the carrier and be glued by hand onto its new carrier, as easily and quickly as a self-adhesive sticker;
- this operation can be carried out in hidden time, since it requires no implementation and no particular know-how to achieve an appearance with a constant level of quality;
- this label adopts geometrically involute shapes, unlike a wax seal;
- this label is made from materials that are highly flexible, highly resistant to hot and cold temperature differences, that meet industrial specifications, unlike "wax seals", which are fragile, breakable, deformable, can deteriorate and are sensitive to heat;
- this label can be produced in all colors, with no colorimetric limitations, and its shape is scalable; and
- this label can be manufactured in large series to meet large requirements, e.g. for forty thousand labels per day.

In some embodiments, the extra thickness comprises pigments of the color of the glass on which the label is intended to be attached. The label that is the subject of the present invention can thus be tinted in the same color as the glass of the bottle to which it is intended to be glued.

According to a second aspect, the present invention envisages a bottle that carries a label that is the subject of the present invention, glued to its surface.

It is recalled that, in the meaning of the present invention, the term "bottle" encompasses not only bottles and flasks, but more generally, any rigid container that can contain a product.

In some embodiments, the bottle that is the subject of the present invention is made of glass and the extra thickness of the label comprises pigments of the color of the glass of the bottle.

According to a third aspect, the present invention envisages a method for manufacturing a 3D self-adhesive label to simulate visually and/or tactilely a decorative molding of the material of a container or a decorative seal applied to the container, comprising:

- a step of applying adhesive onto one surface of a flexible plastic sheet;
- a step of forming, on the surface of the sheet opposite the surface with adhesive applied, an extra thickness comprising a flexible plastic material and covering the edge of the sheet to form a decorative design simulating an engraved relief or an edge of a seal; and
- a step of jointly cutting the peripheries of the extra thickness and of the plastic sheet; the cut edge of the extra thickness thus coming as a continuation of the cut edge of the sheet, up to the lower surface of the sheet of flexible plastic.

As the particular features, advantages and aims of this bottle and of this method that are the subjects of the present invention are similar to those of the label that is the subject of the present invention, they are not repeated here.

In some embodiments, the method that is the subject of the present invention comprises:

- a step of presenting a laminated sheet onto a removable carrier;
- a step of printing a circular stripe with a varnish configured to repel a liquid plastic material being spread;
- a step of half-cutting the shape of the label so as to cut only the thickness of the sheet and not that of the removable carrier;
- a step during which plastic material mixed with hardener is poured outside the resin stop stripe, the resin stopping when it abuts the cut; and
- a step of hardening the plastic material.

In some embodiments, during the step of forming an extra thickness, a digital UV ink jet printing is carried out, thanks to a UV varnish deposited in multiple layers.

In some embodiments, during the step of forming an extra thickness, the extra thickness is poured then hardened.

BRIEF DESCRIPTION OF THE FIGURES

Other particular advantages, aims and features of the invention will become apparent from the non-limiting description that follows of at least one particular embodiment of the label, bottle and method for manufacturing such a label, with reference to drawings included in an appendix, wherein.

DESCRIPTION OF EXAMPLES OF REALIZATION OF THE INVENTION

It is now noted that FIGS. 1-4 are not to scale.

Figure 1:
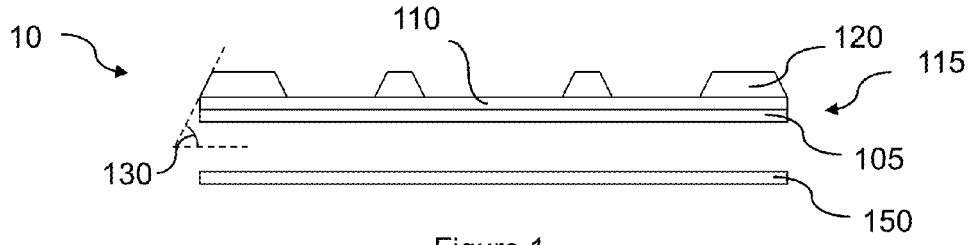
FIG. 1 represents, schematically and in cross section, a first particular embodiment of the label that is the subject of the present invention.
Figure 2:
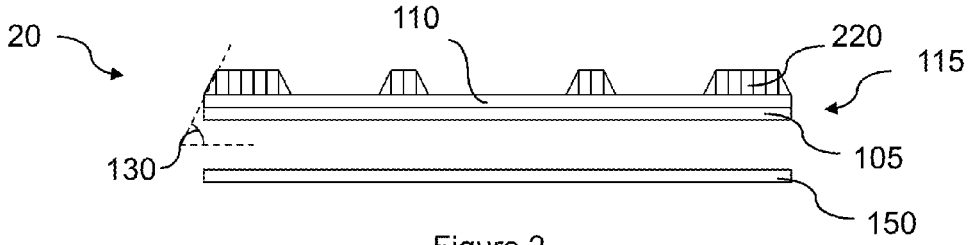
FIG. 2 represents, schematically and in cross section, a second particular embodiment of the label that is the subject of the present invention.
Figure 3A:
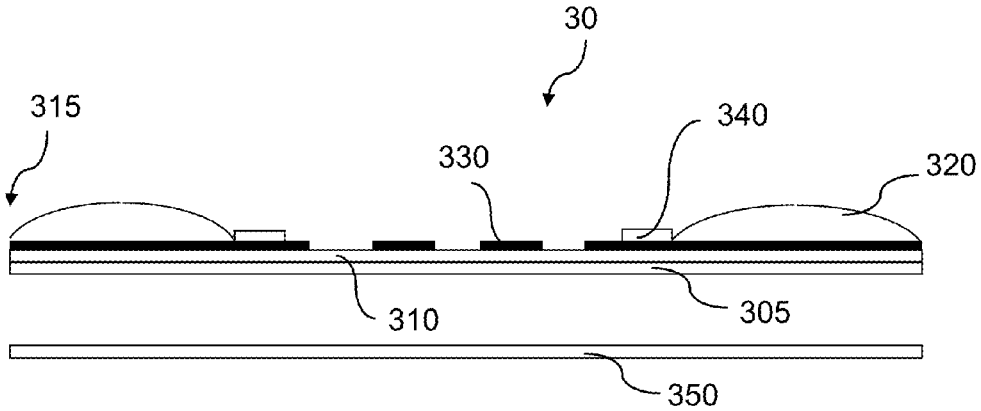
FIG. 3A represents, schematically and in cross section, a third particular embodiment of the label that is the subject of the present invention.
Figure 3B:
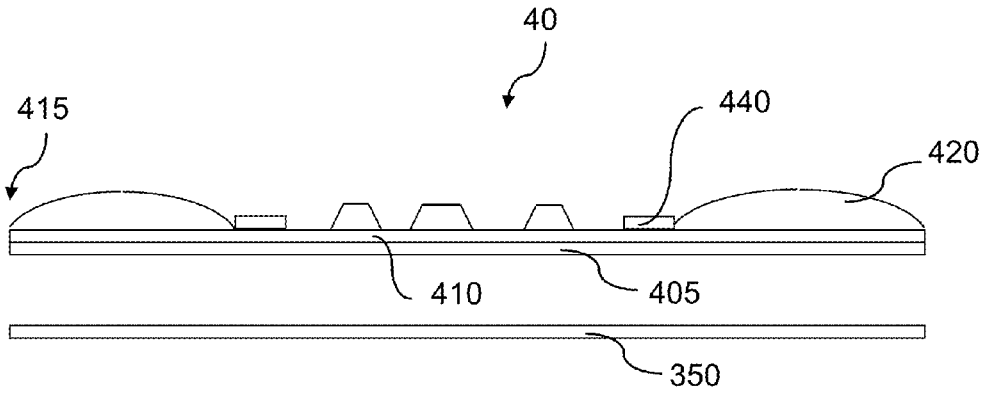
FIG. 3B represents, schematically and in cross section, a fourth particular embodiment of the label that is the subject of the present invention.
Figure 3C:
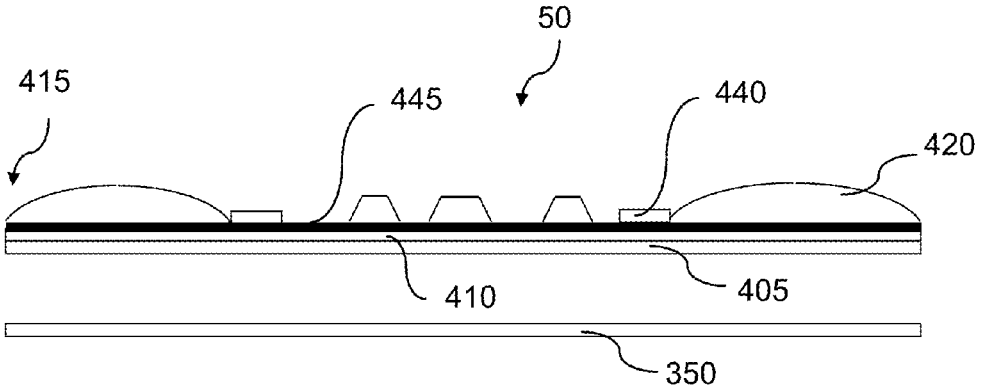
FIG. 3C represents, schematically and in cross section, a fifth particular embodiment of the label that is the subject of the present invention.
Figure 4:
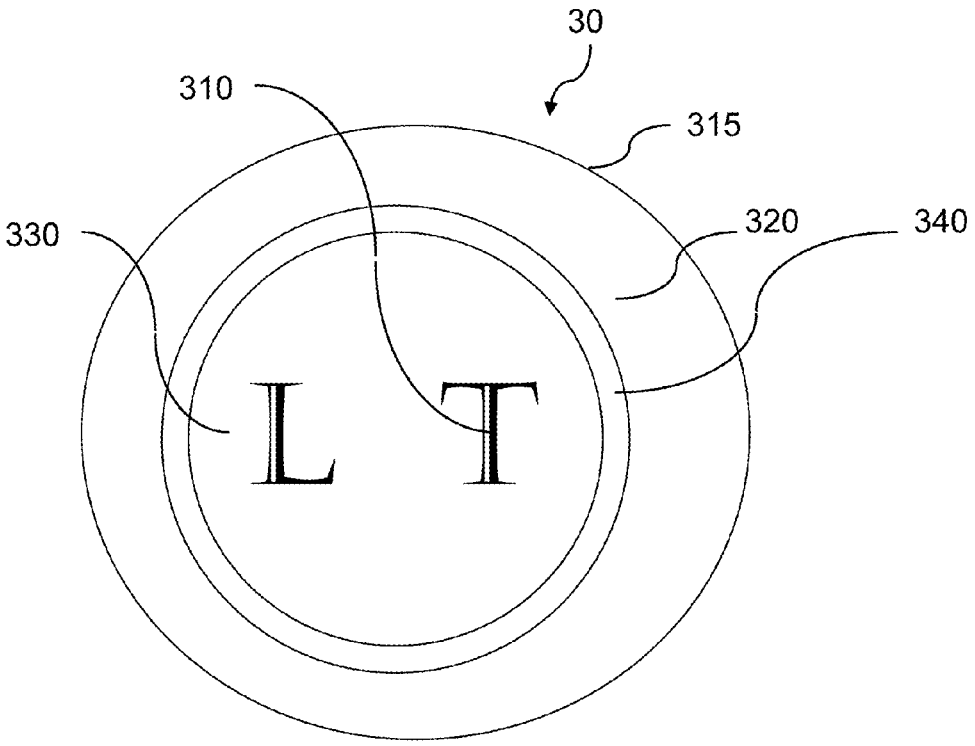
FIG. 4 represents, schematically, in a top view, the third particular embodiment of the label that is the subject of the present invention, illustrated in FIG. 3A.

Schematically, FIG. 1 shows a completely transparent label ("transparent 3D label"), FIG. 2 shows a transparent label, with a printed design ("tinted 3D label"), FIGS. 3A and 4 show an opaque label reproducing a wax seal ("wax seal label with lettering"), FIG. 3B shows a transparent label reproducing a glass seal ("glass seal label"), and FIG. 3C shows an opaque label reproducing a wax seal ("3D wax seal label").

These labels are designed to customize packaging in 3D, e.g. gift boxes or glass bottles. In the remainder of the description, for clarity, this last use is preferred, without limiting the scope of the present invention.

FIG. 1 shows a self-adhesive label 10 comprising:

- a layer of adhesive 105;
- a flexible plastic sheet 110, e.g. made of 60 μm thick polypropylene (PP); and
- an extra thickness 120 covering the edge 115 of the flexible plastic sheet 110.

The self-adhesive label 10 is laminated onto a removable PET/glassine backing 150 (shown unattached as it is not part of the label once it has been glued onto a glass bottle) for transportation. To form the extra thickness 120 of the flexible plastic sheet 110, a 3D acrylic ultraviolet ("UV") curing varnish is used, as set out with reference to FIG. 5.

In the embodiment illustrated in FIG. 1, the extra thickness of varnish 120, the adhesive 105 and the flexible plastic sheet 110 are, at least partially, transparent.

The extra thickness 120 is formed on the surface of the flexible plastic sheet 110 opposite the layer of adhesive 105. The extra thickness comprises a flexible plastic material and covers the edge 115 of the sheet to form a decorative design simulating an engraved or molded glass relief. The peripheries of the extra thickness 120 and of the flexible plastic sheet 110 are cut jointly. The cut edge 115 of the extra thickness 120 thus comes as a continuation of the cut edge of the sheet 110, up to the lower surface of the flexible plastic sheet 110.

Preferably, the angle of the jointly-cut edges of the extra thickness 120 and the flexible plastic sheet 110 to the lower surface of the flexible plastic sheet 110 is 90 degrees. This characteristic also applies to the other embodiments described with regard to the figures.

The extra thickness of varnish 120 forms a border in 3D at least 1.5 mm wide and at least 250 μm thick, which follows the outline of the label.

Preferably, the angle 130 of the surface of the sheet to the edge of the extra thickness of plastic material 120, at the limit of the joint cutting area, is over 45° to match an angle generally formed by a glass molding.

This border in relief 120 that follows the outline of the label 10 creates an esthetic barrier and has two functions:

- making the edges of the label 10 invisible once the label 10 has been pressed up against the glass of a bottle (not shown), thanks to a cutout in the mass of its outline; and
- partitioning two different materials, firstly the bottle's glass and secondly the synthetic material of the label 10, to prevent the consumer from comparing their aspect and brightness.

Figure 5:
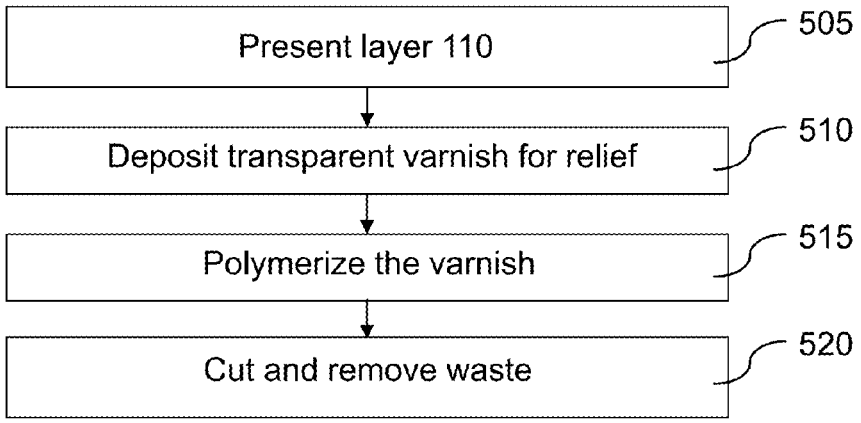
FIG. 5 represents, in the form of a logical diagram, steps in a first particular embodiment of the method that is the subject of the present invention.

As illustrated in FIG. 5, to produce the label 10, the following are utilized successively:

- a step 505 of presenting a flexible plastic sheet 110 assembled to a layer of adhesive 105 laminated onto a removable carrier 150;
- at least one step 510 of depositing UV-polymerized acrylic varnish to form a 3D extra thickness on the sheet 110 that follows the outline of the sheet 110;
- a step 515 of polymerizing the varnish and
- a step 520 of jointly cutting the periphery of the extra thickness and of the sheet, and of removing waste from the edges of the cut.

To produce the label 10, the following means can be utilized:

- an adhesive carrier is used, e.g. of type "PPTOP CLEAR" (registered trademark), translucent after complete polymerization of the adhesive in 48 hours. Its invisible and brilliant aspect, identical to glass, makes it possible to work on all types of tinted bottles, including clear glass bottles, even filled with clear alcohol, e.g. vodka; and
- the tension of the varnish film that forms the relief is achieved thanks to the use of a flexible Polyurethane squeegee to deposit as much UV varnish as possible.

The label 10 has the following characteristics and advantages:

- the sheet 110 of 60 μm transparent Polypropylene flexible plastic material, with a complexed backing 150 (PET/glassine paper ridge), makes the label completely translucent once affixed to a glass bottle, thanks to the absence of traces of adhesive due to the smoothing of the adhesive by the smooth PET backing; and the extra thickness comprises the border in relief 120, which follows the outline of the label and partitions the two materials (the bottle's glass and the label's visible material), and prevents the edges of the label 10 from being visible.

The label 10 is cost-effective, esthetically pleasing, and easy to install by hand or with a standard labeler fitted with ultrasound cells that detect the labels, even if they are transparent, and the reliefs. Utilizing it makes it possible to customize small, medium and large quantities of bottles at a low cost, while avoiding the constraints of glassmakers, such as capital investment for the mold, a large minimum quantity, required storage, blocked funds.

FIG. 2 shows a self-adhesive label 20 comprising:

the layer of adhesive 105;

the flexible plastic sheet 110, e.g. made of polypropylene; and a tinted extra thickness 220 covering the edge 115 of the flexible plastic sheet 110.

The self-adhesive label 20 is laminated onto a removable PET/glassine backing 150 (shown unattached as it is not part of the label once it has been glued onto a glass bottle) for transportation.

The label 20 has the same technical characteristics as the label 10, except that the flexible plastic sheet 110 bears a tinted design 220 rather than a transparent design. Preferably, the tinted 3D printing forming the extra thickness 220 is doubled with a transparent varnish. Preferably, the printed design of the extra thickness 220 is formed by a tinted layer of a transparent varnish and pigments of the color of the glass and a layer of the same varnish, transparent or also tinted, superimposed on the tinted layer.

The extra thickness 220 is formed on the surface of the flexible plastic sheet 110 opposite the layer of adhesive 105. The extra thickness comprises a flexible plastic and covers the edge 115 of the sheet 110 to form a decorative design simulating an engraved or molded glass relief. The peripheries of the extra thickness 220 and of the flexible plastic sheet 110 are cut jointly. The cut edge 115 of the extra thickness 220 thus comes as a continuation of the cut edge of the sheet 110, up to the lower surface of the flexible plastic sheet 110.

The varnish is a 3D UV varnish, for example an acrylic resin with UV polymerization. The pigments mixed with a transparent UV varnish produce a semi-transparent tint, transparent enough to let light pass through the bottle's glass and give a visually uniform result.

Applied to a glass bottle, the label 20 imitates the appearance and feel of a bottle with a 3D engraving or molding made by a glassmaker. Preferably, the color of the tint of the extra thickness 220 is the color of the glass of the bottle to which the label 20 is intended to be glued. Thus, the 3D printing is tinted with pigments to match the color of the glass of the bottle.

The label 20 is cost-effective, esthetically pleasing, can be printed in two or even three colors, and easy to affix by hand or with a standard labeler. Utilizing it makes it possible to customize small, medium and large quantities of bottles at a low cost, while avoiding the constraints of glassmakers.

Figure 6:
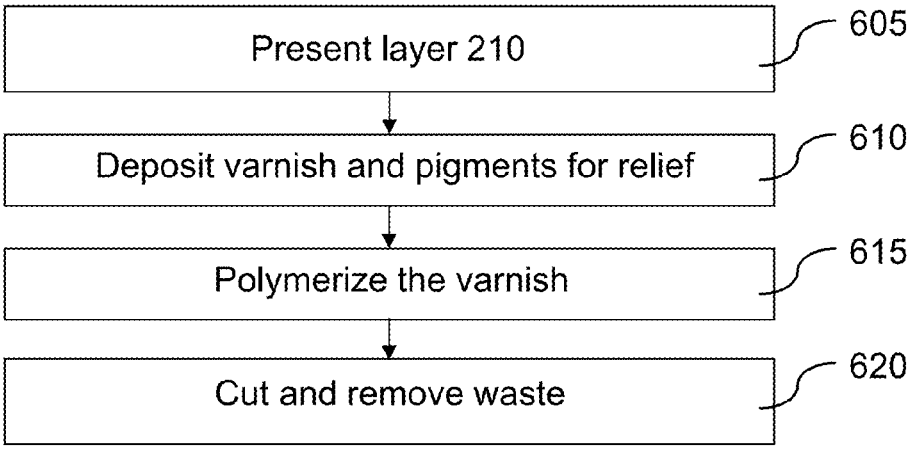
FIG. 6 represents, in the form of a logical diagram, steps in a second particular embodiment of the method that is the subject of the present invention.

As illustrated in FIG. 6, to produce the label 20, the following are utilized successively:

a step 605 of presenting a flexible plastic sheet 110 assembled to a layer of adhesive 105 laminated onto a removable carrier 150;

at least one step 610 of depositing UV-polymerizable acrylic varnish mixed with colored pigments to form a tinted 3D extra thickness relief on the flexible plastic sheet 110.

a step 615 of polymerizing the varnish and a step 620 of jointly cutting the peripheries of the extra thickness and of the sheet, and of removing waste from the edges of the cut.

To produce the label 20, the following means can be utilized:

an adhesive carrier is used, e.g. of type "PP Top Clear" (registered trademark), translucent after complete polymerization of the adhesive in 48 hours. Its invisible and brilliant aspect, identical to glass, makes it possible to work on all types of tinted bottles, including clear glass bottles, even filled with clear alcohol, e.g. vodka; and a flat-bed reel-to-reel screen printing machine is used, fitted with at least two print heads and with two UV-polymerization dryers and a flatbed cutter; Reel-to-reel rotary screen printing machines can also be used, fitted with at least two screen-printing heads and two UV-polymerization dryers and a rotary cutting station. For this configuration, the cylindrical screens replace the flatbed screen printing stencils. These provide improved definition through the technique for depositing varnish, faster print speeds and a more reliable, higher-quality rotary cut. A flexible printing squeegee is used.

a screen printing stencil destined for a first printing stage is made with a polyester fabric and a medium mesh size. This first screen printing is made with the 3D varnish from VFP or DUBUIT (registered trademarks). These varnishes are tinted with MICROLITH pigments from BASF (registered trademarks), assembled and marketed by ENCRES DUBUIT (registered trademark), making it possible to reproduce the color of the bottle glass by matching;

a screen printing stencil destined for a second printing stage is made with a polyester fabric and a large mesh size. This second screen printing is carried out exclusively with the "UV RELEX" (registered trademark) 3D varnish from VFP or the HMA 3034 varnish from ENCRES DUBUIT (registered trademarks). These varnishes can also be tinted. This second printing is only to provide relief, transparency and brilliance;

the tension of the varnish film is achieved by using a flexible squeegee; and the number of printing cycles per hour is 1100 cycles/hour.

The label 20 has the following characteristics and advantages:

a 3D printing with pigments to match the color of the bottle glass gives the illusion to the consumer that the bottle's material is engraved;

a multi-layer printing method consisting of superimposing a first layer tinted to the same color as the glass, a layer of transparent or tinted varnish makes it possible to obtain the relief while preventing the risks of visible detection;

a border in relief of the extra thickness 220, which follows the outline of the label partitions the two materials and prevents the edges of the label being visible; and the ability to have two or three different colors in relief on a single bottle, which a glassmaker cannot achieve.

FIGS. 3A and 4 show a self-adhesive label 30 simulating a wax seal and comprising:

a layer of adhesive 305;

a sheet 310 of metallized polyester, for example, 80 μm thick; and a layer 320 of flexible plastic material forming an extra thickness whose periphery is cut jointly with the periphery of the sheet 310.

For the label 30 to have the shape of a wax seal, the layer 320 forms a 3D border (or a rim) that follows the irregular outlines of the label 30 and covers the edge 315 of the sheet 310.

The extra thickness 320 is formed on the surface of the flexible plastic sheet 310 opposite the layer of adhesive 305. The extra thickness 320 comprises a flexible plastic material and covers the edge 315 of the sheet to form a decorative design simulating an edge of a seal. The peripheries of the extra thickness 320 and of the flexible plastic sheet 310 are cut jointly. The cut edge 315 of the extra thickness 320 thus comes as a continuation of the cut edge of the sheet 310, up to the lower surface of the flexible plastic sheet 310.

Preferably, the angle of the surface of the sheet 310 to the edge of the extra thickness of plastic material 320, at the limit of the joint cutting area, is over 45°.

The self-adhesive label 30 is laminated onto a removable PET/glassine carrier 350 (shown unattached as it is not part of the label once it has been glued onto a glass bottle) for transportation.

The sheet 310 carries a print 330 and a circular "resin stop" stripe 340 printed with an aqueous or UV varnish, configured to repel a predefined flexible plastic material, the layer 320 being formed with this predefined flexible plastic material being poured before hardening. For example, the extra thickness 320 is made of polyurethane resin mixed with isocyanate hardener, which cures when heated. Preferably, the material of the extra thickness 320 is transparent so there is continuity of color between, firstly, the central portion, where the color of the printing 330 is directly seen and, secondly, the extra thickness 320 through which the color of the printing 330 is seen.

The sheet 310 bears, on the side opposite the adhesive, the printing of a solid color area with text in a margin, allowing the gold or silver metallized color of the sheet 310 to be seen. The text ("LT" in FIG. 4) thus appears in a box by not printing the solid area.

It should be noted that the polyurethane resin used complies with all current standards: ROHS, toys, food, automobile, lead- and mercury free, no heavy metals. To pour the resin, called "doming", a special machine is used, for example, which is able to reproduce all the shapes and texts from 3 to 4 mm wide, with a thickness of over 1.5 mm. This machine is fitted with an arm articulated around two digital axes able to reproduce any form based on a computer file using vector drawing programs.

The computer file that made it possible to make the cutting tool is also used for programming the various motions of the arm, on which nozzles are arranged (from 2 to 24 nozzles, in even numbers, depending on the number of seals per sheet), which carry the exact quantity of resin propelled by metering pumps according to a preselected program.

This machine is fitted with a suction table to receive the backing sheets with pre-printed seals. The suction and positioning of the sheet during the "doming" period must be perfect, so that the poured resin perfectly follows the seal's outlines.

The advantages of the label 30 comprise, compared to a conventional wax seal:

the label 30 eliminates the painstaking set up for a genuine "wax seal", where the wax has to be softened, poured onto the object, the wax stamped with a more or less successful rendering, all with low yields; and the label 30 is delivered on backing sheets; the label 30 can be removed from its carrier and glued by hand onto its new carrier, as easily and quickly as a self-adhesive sticker; This operation can be carried out in hidden time, since it requires no implementation and no particular know-how to achieve a visual with perfect and constant quality;

the label 30 adopts geometrically involute shapes, unlike a wax seal;

the label 30 is made from flexible, highly resilient materials that meet industrial specifications, unlike "wax seals", which are fragile, breakable, deformable, and can deteriorate;

the label 30 can be produced in all colors, with no colorimetric limitations, and its shape is scalable;

unlike a monochrome wax seal, a gold or silver center design (logo, coat of arms) can be achieved; and the label 30 can be manufactured in large series to meet large requirements, e.g. at a rate of 40,000 seals/day.

Figure 7:
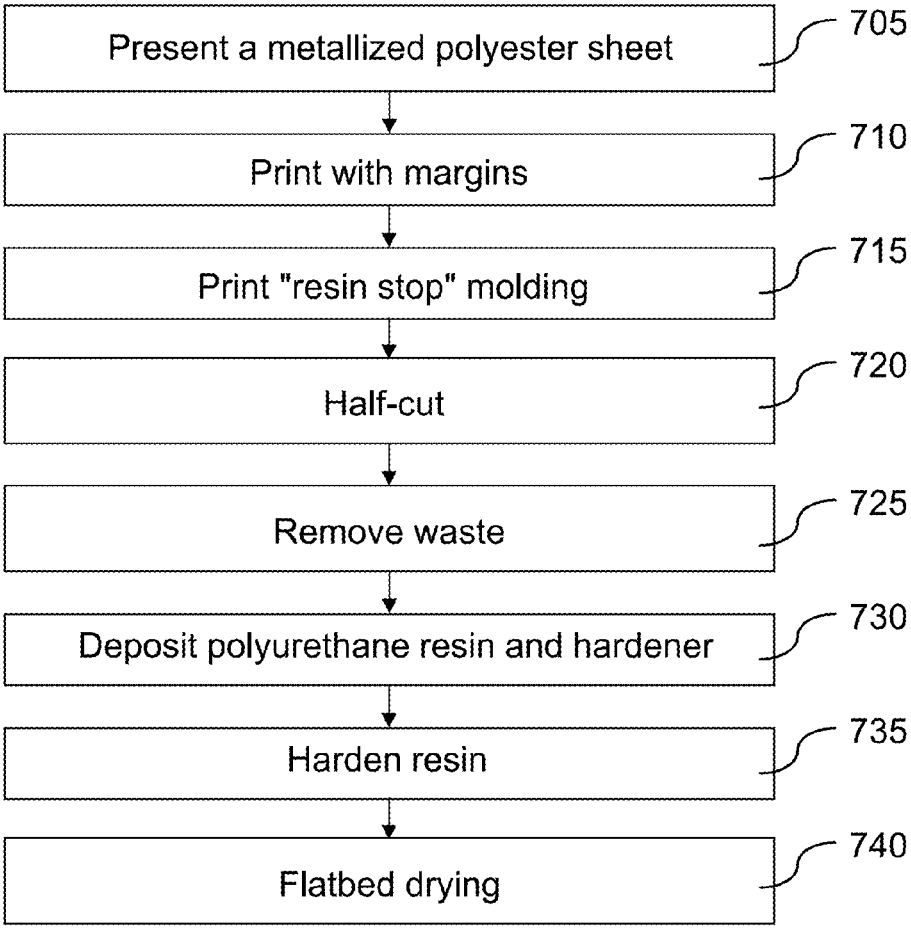
FIG. 7 represents, in the form of a logical diagram, steps in a third particular embodiment of the method that is the subject of the present invention.

As illustrated in FIG. 7, to produce the label 30, the following means can be utilized:

during a step 705, a sheet of self-adhesive metallized polyester is positioned, laminated onto a silicone paper or glassine backing;

during a step 710, a solid color area with margins (round border matching the inner shape of a stamp, initials, coats of arms, vintages, etc.) is screen printed on the polyester sheet with a UV-curing matte ink so as to achieve an opaque background and a bright gold or silver visual;

during a step 715, around the printed central visual, a circular "ink stop" or "resin stop" stripe 1 mm wide is screen printed with an aqueous or UV varnish specially formulated and manufactured by CHEMQUE (registered trademark), which forms a delineating barrier to stop the polyurethane resin during the "doming" or "resin depositing" operation (step 420). Its property consists of repelling the polyurethane resin during its spreading phase, the goal being to control exactly the places where it is desired that the resin spreads or does not spread over well-defined areas, hence the name "selective resin";

during a step 720, the shape of a wax seal, selected beforehand at a distance of 4, 5 or 6 mm from the circular "resin stop" stripe, is half-cut, using a die cutting tool fixed to a cutting plate or a computer-aided digital cutting plotter (e.g. machine for cutting vinyl to a shape). Thus, only the extra thickness 320 and the thickness of the PVC PP or polyolefin sheet 310 are cut, not that of the silicone paper forming the backing;

during a step 725, once the extra thickness and polyester sheet have been cut, the surplus portions of the sheet are removed, leaving only the shapes of the pre-cut screen printed seals with a bright gold or silver visual to appear on the silicone sheet;

during a step 730, the polyurethane resin mixed with isocyanate hardener is poured outside the "resin stop" stripe, the resin stopping when it abuts the cut carried out in step 720; the difference in the levels of the edges of the cut in the PVC, PP or polyolefin sheet and the "resin stop" border stop the resin thanks to a physicochemical balance through a combination of the formulation of the polyurethane resin and the surface tension of the printed carrier;

during a step 735, polymerization of the polyurethane resin, and therefore of the rim 320, is caused with a hardener; the completely translucent resin gives a 3D magnifier effect to the color background, and a 3D dome aspect. Managing the volume of resin in relation to the surface to be covered makes it possible to reproduce the relief of a genuine wax seal (about 2.5 mm high). It is impossible to manufacture 3D of this quality either in terms of height or look by any other method; and during a step 740, the sheets of seals, once domed, are stored flat on drying racks. The resin is thoroughly dried, for example for about six hours at a temperature of 35° C. to 40° C. and humidity regulated to 40%.

FIG. 3B shows a self-adhesive label 40 simulating a wax seal and comprising:

a layer of transparent adhesive 405;

a sheet 410 of PVC PP or transparent polyolefin, for example, 60 or 100 μm thick; and a layer 420 of transparent flexible plastic material forming an extra thickness whose periphery is cut jointly with the periphery of the sheet 410, the cut edge of the extra thickness thus coming as a continuation of the cut edge of the sheet 410 up to the lower surface of the sheet of flexible plastic 410.

For the label 40 to have the shape of a glass seal, the layer 420 forms a 3D border that follows the irregular outlines of the label 40 and covers the edge 415 of the sheet 410. Preferably, the angle of the surface of the sheet to the edge of the extra thickness of plastic material, at the limit of the joint cutting area, is over 45°.

The self-adhesive label 40 is laminated onto a removable PET/glassine carrier 350 (shown unattached as it is not part of the label once it has been glued onto a glass bottle) for transportation.

The sheet 410 carries a 3D printing in its central portion and outside the border 420. This 3D printing is made in the same way as the printing in relief of the labels 10 and 20, as set out with reference to FIGS. 1, 2, 5 and 6.

The sheet 410 has a circular "resin stop" stripe 440 printed with a UV varnish, configured to repel a predefined flexible plastic material, the layer 420 being formed with this predefined flexible plastic material being poured before hardening. For example, the layer 420 is made of polyurethane resin mixed with isocyanate hardener, which cures when heated.

The label 40 avoids having to mold the glass of a bottle to form a decorative relief on it.

Figure 8:
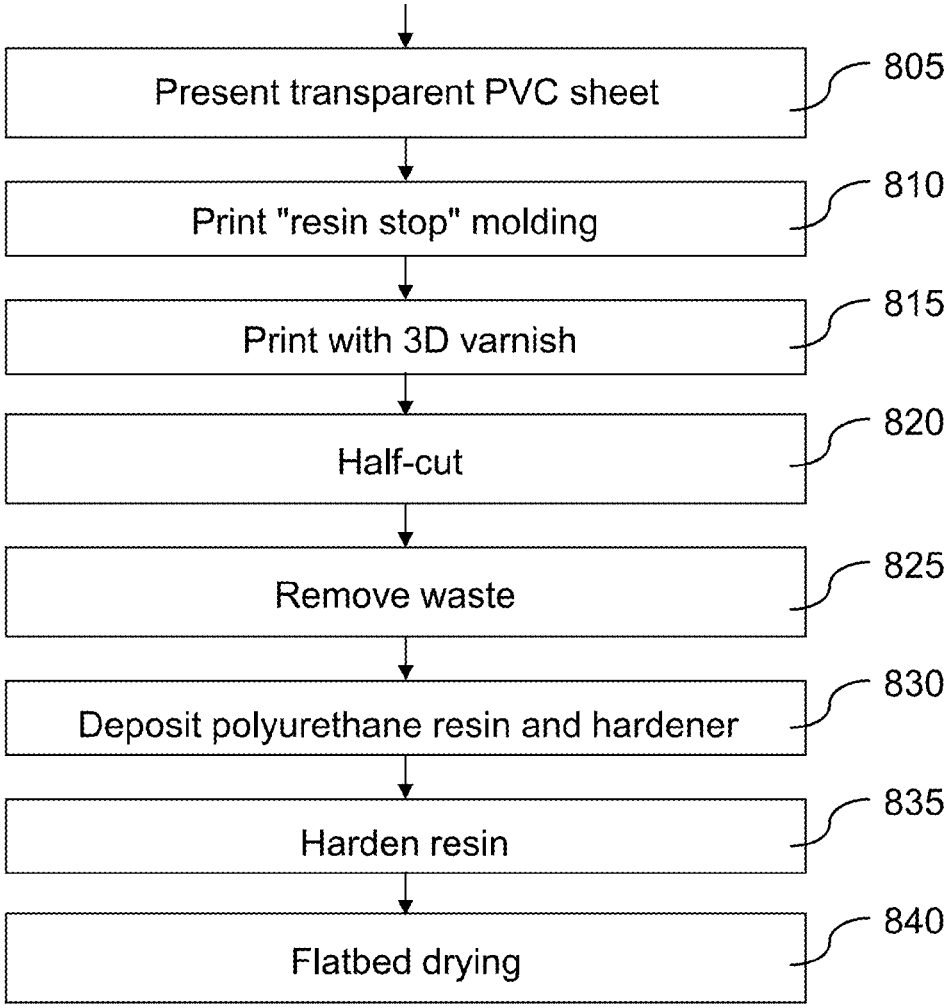
FIG. 8 represents, in the form of a logical diagram, steps in a fourth particular embodiment of the method that is the subject of the present invention.

As illustrated in FIG. 8, to produce the label 40, the following means can be utilized:

during a step 805, a sheet of self-adhesive transparent PVC is positioned, laminated onto a glassine backing;

during a step 810, a circular "ink stop" or "resin stop" stripe 1 mm wide is screen printed with an aqueous or UV varnish specially formulated and manufactured by CHEMQUE (registered trademark), which forms a delineating barrier to stop the polyurethane resin during the "doming" or "resin depositing" operation (step 420). Its property consists of repelling the polyurethane resin during its spreading phase, the goal being to control exactly the places where it is desired that the resin spreads or does not spread over well-defined areas, hence the name "selective resin";

during a step 815, a transparent UV curing acrylic relief varnish is screen printed on the central portion;

during a step 820, the shape of a wax seal, selected beforehand at a distance of 4, 5 or 6 mm from the circular "resin stop" stripe, is half-cut, using a die cutting tool fixed to a cutting plate or a computer-aided digital cutting plotter (e.g. machine for cutting vinyl to a shape). Thus, only the extra thickness and the thickness of the PVC PP or transparent polyolefin sheet are cut, not that of the silicone paper;

during a step 825, once the extra thickness and the polyester sheet have been cut, the surplus portions of the sheet are removed, leaving only the shapes of the pre-cut stamps screen printed in relief and tinted with a bright gold or silver visual to appear on the silicone sheet;

during a step 830, the polyurethane resin mixed with isocyanate hardener is poured outside the "resin stop" stripe, the resin stopping when it abuts the cut carried out in step 820; the difference in the levels of the edges of the cut in the PVC sheet and the "resin stop" border stops the resin thanks to a physicochemical balance through a combination of the formulation of the polyurethane resin and the surface tension of the carrier;

during a step 835, polymerization of the polyurethane resin, and therefore of the rim 420, is caused with a hardener; the completely translucent resin gives a 3D magnifier effect to the color background, and a 3D dome aspect. Managing the volume of resin in relation to the surface to be covered makes it possible to reproduce the relief of a genuine wax seal (about 2.5 mm high). It is impossible to manufacture 3D of this quality either in terms of height or look by any other method; and during a step 840, the sheets of seals, once domed, are stored flat on drying racks. The resin is thoroughly dried, for example for about six hours at a temperature of 35° C. to 40° C. and humidity regulated to 40%.

FIG. 3C shows a self-adhesive label 50 simulating a wax seal and comprising:

a layer of adhesive 405;

a sheet 410 of PVC PP or transparent polyolefin, for example, 100 μm thick; and a layer 420 of flexible plastic material forming an extra thickness whose periphery is cut jointly with the periphery of the sheet 410, the cut edge of the extra thickness thus coming as a continuation of the cut edge of the sheet 410 up to the lower surface of the sheet of flexible plastic 410.

The label 50 is similar to the label 40, except for an additional printing 445 on the sheet 410 on the side opposite the adhesive 405, of two screen printed solid areas of UV curing matte ink superimposed on each other to obtain a completely opaque color background. A label simulating a monochrome wax seal is thus produced without the drawbacks of a wax seal.

Figure 9:
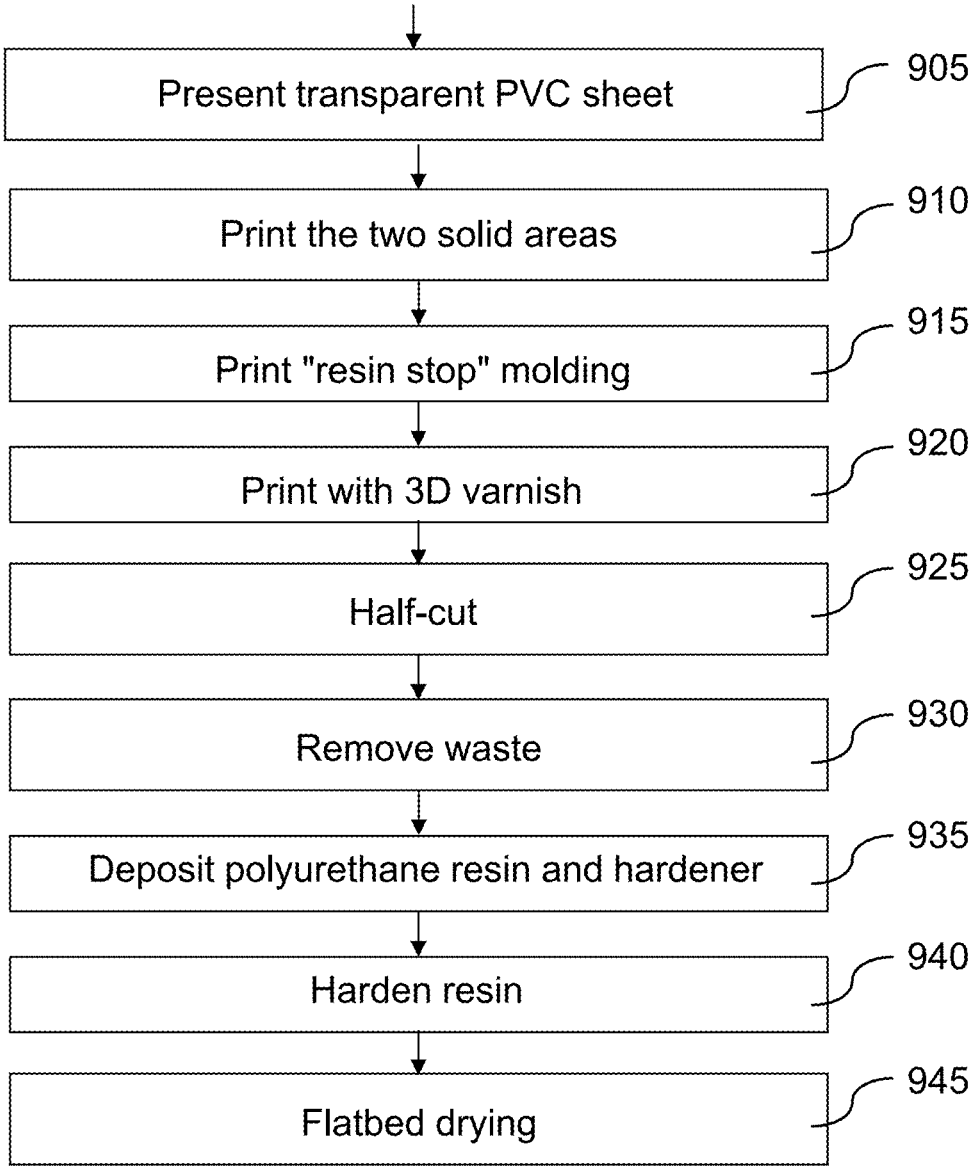
FIG. 9 represents, in the form of a logical diagram, steps in a fifth particular embodiment of the method that is the subject of the present invention.

As illustrated in FIG. 9, to produce the label 50, the following means can be utilized:

during a step 905, a sheet of self-adhesive transparent PVC, PP or polyolefin is positioned, laminated onto a glassine backing;

during a step 910 two solid areas, superimposed on each other so as to achieve a completely opaque background, are screen printed on the PVC, PP or polyolefin sheet with a UV-curing matte ink;

during a step 915, a circular "ink stop" or "resin stop" stripe 1 mm wide is screen printed with an aqueous or UV varnish specially formulated and manufactured by CHEMQUE (registered trademark), which forms a delineating barrier to stop the polyurethane resin during the "doming" or "resin depositing" operation (step 420). Its property consists of repelling the polyurethane resin during its spreading phase, the goal being to control exactly the places where it is desired that the resin spreads or does not spread over well-defined areas, hence the name "selective resin";

during a step 920, a UV curing acrylic relief varnish, tinted according to the color of the solid areas, is screen printed on the central portion;

during a step 925, the shape of a wax seal, selected beforehand at a distance of 4, 5 or 6 mm from the circular "resin stop" stripe, is half-cut, using a die cutting tool fixed to a cutting plate or a computer-aided digital cutting plotter (e.g. machine for cutting vinyl to a shape). Thus, only the extra thickness and the thickness of the PVC PP or transparent polyolefin sheet are cut, not that of the silicone paper;

during a step 930, once the extra thickness and the PVC, PP or polyolefin sheet have been cut, the surplus portions of the sheet are removed, leaving only the shapes of the pre-cut screen printed seals with a 3D tinted visual to appear on the silicone sheet;

during a step 935, the polyurethane resin mixed with isocyanate hardener is poured outside the "resin stop" stripe, the resin stopping when it abuts the cut carried out in step 925; the difference in the levels of the edges of the cut in the PVC sheet and the "resin stop" border stop the resin thanks to a physicochemical balance through a combination of the formulation of the polyurethane resin and the surface tension of the printed carrier;

during a step 940, polymerization of the polyurethane resin, and therefore of the rim 420, is caused with a hardener; the completely translucent resin gives a 3D magnifier effect to the color background, and a 3D dome aspect. Managing the volume of resin in relation to the surface to be covered makes it possible to reproduce the relief of a genuine wax seal (about 2.5 mm high). It is impossible to manufacture 3D of this quality either in terms of height or look by any other method; and during a step 945, the sheets of seals, once domed, are stored flat on drying racks. The resin is thoroughly dried, for example for about six hours at a temperature of 35° C. to 40° C. and humidity regulated to 40%.

Figure 10:
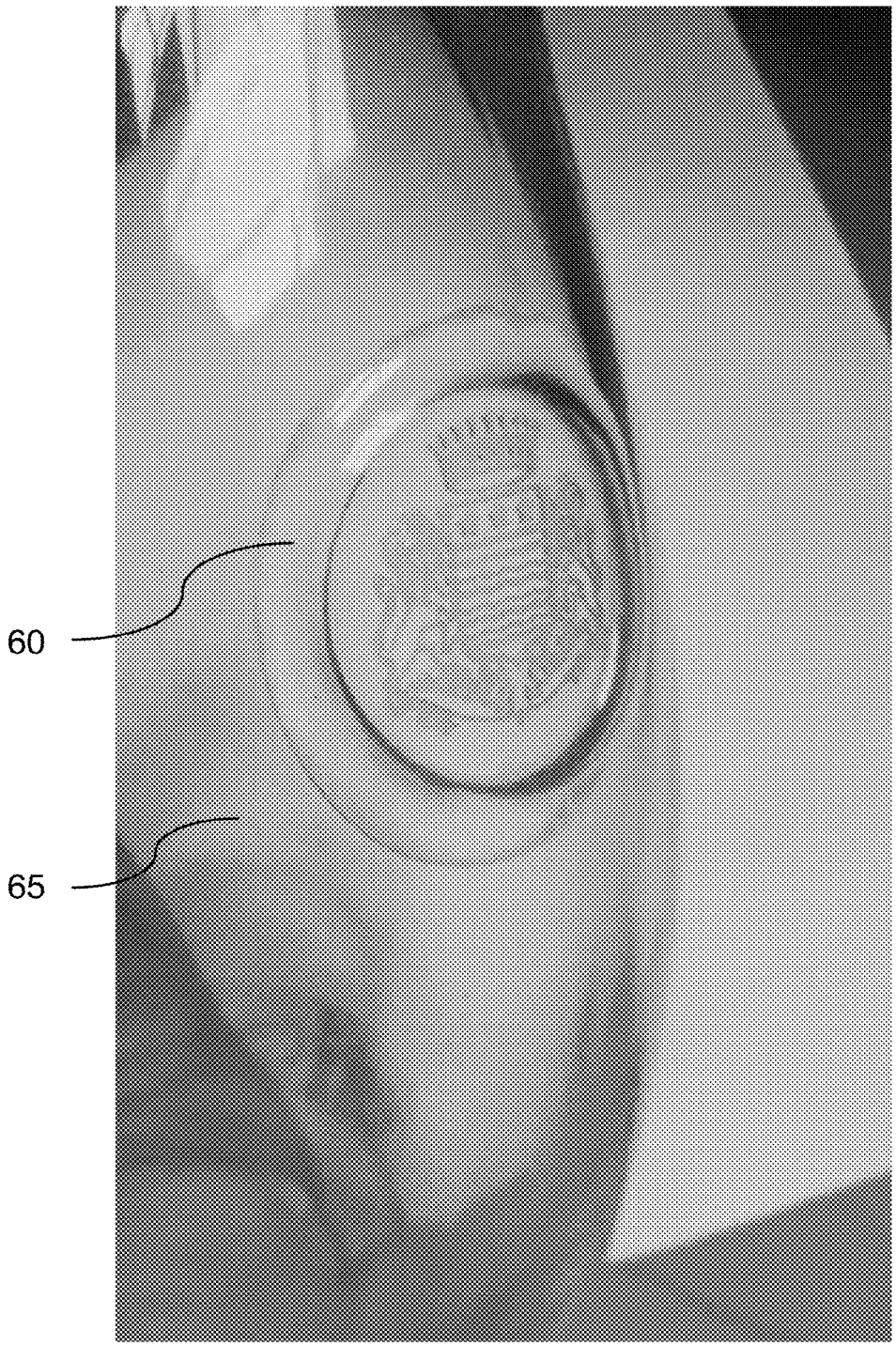
FIGS. 10-13 represent, in the form of photographs, labels that are the subjects of the present invention glued onto bottles.
Figure 11:
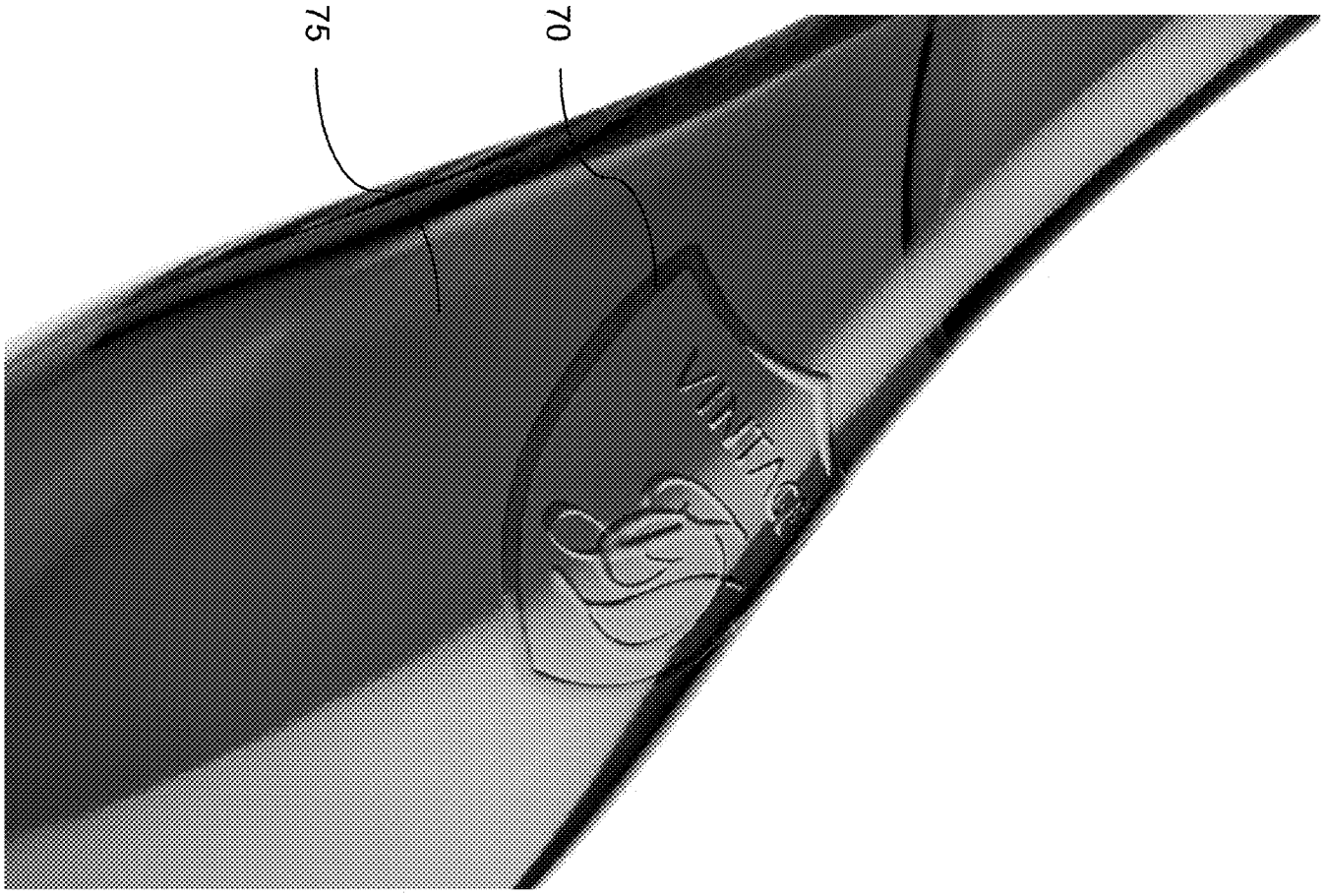
Figure 12:
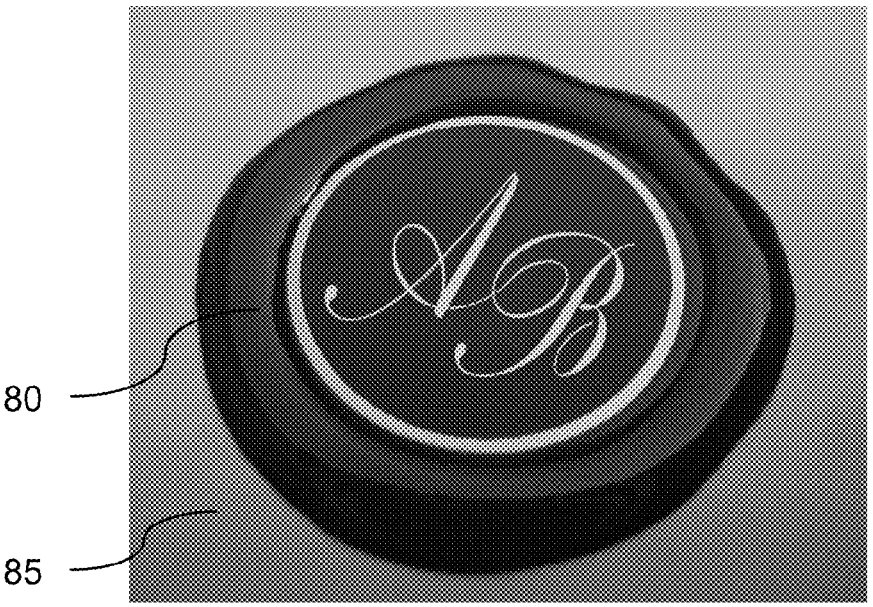
Figure 13:
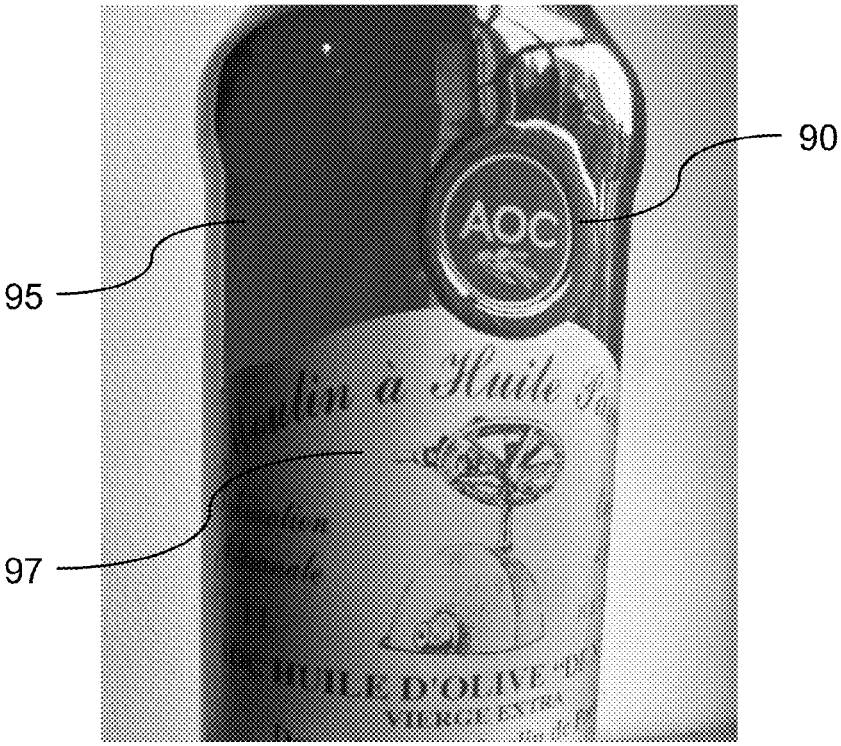

FIGS. 10-13 represent, as photographs, labels that are the subjects of the present invention glued onto bottles:

FIG. 10 shows a transparent glass seal label 60 affixed on a bottle 65; as can be seen, the separations between the glass, the flexible plastic sheet, and the extra thickness are invisible;

FIG. 11 shows a tinted 3D label 70 affixed on a bottle 75; as can be seen, the separations between the glass, the flexible plastic sheet, and the extra thickness are invisible and the tint of the label matches the tint of the glass that forms the bottle;

FIG. 12 shows a wax seal label 80 with lettering affixed on a bottle 85; as can be seen, the separation between the flexible plastic sheet and the extra thickness are invisible;

FIG. 13 shows a wax seal label 90 with lettering affixed on a bottle 95 and onto a paper label 97; as can be seen, the separation between the flexible plastic sheet and the extra thickness are invisible.

Of course, the various embodiments can be combined to form other types of labels. For example, a label may have the printing with margins on metallized polyester sheets as illustrated in FIGS. 3A, 4 and 7, and a transparent relief superimposed on this printing, as illustrated in FIGS. 3C and 9. Similarly, the printed reliefs illustrated in FIGS. 3B, 3C 8 and 9 can be made with a tinted varnish as set out with reference to FIGS. 2 and 6.

In a variant, to make the extra thickness of the label, 3D UV inkjet printing is utilized, similar to inkjet printing but without necessarily the material being tinted. In some variants, during the step of forming an extra thickness, a digital UV ink jet printing is carried out, thanks to a UV varnish deposited in multiple layers.

The thickness of such a printing can reach, for example 500 μm.

Small and medium-size runs of labels can be handled and tooling costs sharply reduced. For labels designed to customize clear glass bottles, during the application by inkjet of the varnish in 3D, a complete absence of air bubbles is noted, giving at the end a completely translucent varnish, unlike a screen-printed varnish that may become laden with bubbles and lose its transparency.

In some variants, embossing or forming and thermoforming techniques are utilized, which consist of deforming the synthetic or paper backing and giving it a relief forming an extra thickness.

In some variants, a postcure or remelting of the label is utilized, before or after it is affixed to the container, to reduce internal tensions and improve the label's conforming to the surface of the container, which may be curved and non-involute.

The invention claimed is:

1. A self-adhesive label produced in relief in order to visually and/or tactilely simulate a decorative molding of a material of a container or a decorative seal or stamp applied to the container, the self-adhesive label comprising:

a layer of adhesive;

a flexible plastic sheet having an cut edge at a periphery of the flexible plastic sheet, one face of the flexible plastic sheet being entirely covered by the layer of adhesive; and an extra thickness formed on a surface of the flexible plastic sheet opposite the layer of adhesive, the extra thickness having an uppermost first surface and a lowermost second surface in contact with the flexible plastic sheet, and being comprised of a flexible plastic material from the uppermost first surface to the lowermost second surface, the lowermost second surface of the extra thickness being in contact with and covering the upper second face of the flexible plastic sheet at the cut edge of the flexible plastic sheet, the extra thickness, from the uppermost first surface to the lowermost second surface, forming a decorative design simulating an engraved relief or an edge of a seal, the extra thickness having an cut edge extending from i) a periphery of the lowermost second surface of the extra thickness to ii) a periphery of the uppermost first surface of the extra thickness, wherein the cut edge at the periphery of the extra thickness and the cut edge at the periphery of the flexible plastic sheet are cut jointly, the cut edge at the periphery of the lowermost second surface of the extra thickness coinciding with the cut edge of the flexible plastic sheet as a continuation of the cut edge of the flexible plastic sheet to a lower surface of the flexible plastic sheet.

2. The self-adhesive label according to claim 1, wherein the layer of adhesive, the flexible plastic sheet and the extra thickness of flexible plastic are, at least in part, transparent.

3. The self-adhesive label according to claim 1, wherein the extra thickness does not cover the entire flexible plastic sheet.

4. The self-adhesive label according to claim 1, wherein the flexible plastic sheet comprises translucent polypropylene.

5. The self-adhesive label according to claim 1, which further comprises a removable carrier comprising a PET ridge laminated onto glassine.

6. The self-adhesive label according to claim 1, wherein the extra thickness comprises an acrylic 3D varnish polymerizable by ultraviolet rays.

7. The self-adhesive label according to claim 1, wherein the extra thickness comprises digital ink printing with a UV varnish.

8. The self-adhesive label according to claim 1, wherein the extra thickness is poured then hardened.

9. The self-adhesive label according to claim 1, wherein the flexible plastic sheet bears a "resin stop" molding printed with an aqueous or UV varnish configured to repel a predefined flexible plastic material, the extra thickness being formed with said predefined flexible plastic material.

10. The self-adhesive label according to claim 1, wherein the extra thickness comprises polyurethane resin mixed with isocyanate hardener.

11. The self-adhesive label according to claim 1, wherein the flexible plastic sheet comprises metallized polyester.

12. The self-adhesive label according to claim 1, wherein the flexible plastic sheet bears a printed solid area with a margin.

13. The self-adhesive label according to claim 1, wherein the flexible plastic sheet is made of PVC, PP or transparent polyolefin.

14. The self-adhesive label according to claim 1, wherein the flexible plastic sheet carries printing of two screen-printed solid areas of matte ink, superimposed on each other forming a totally opaque color background.

15. The self-adhesive label according to claim 1, wherein the extra thickness forms a border in relief at least 1.5 mm wide and at least 250 μm thick, which follows the outline of the label.

16. The self-adhesive label according to claim 1, wherein the extra thickness is formed from a first tinted layer of transparent varnish and pigments, and from a second layer of the same varnish, transparent or tinted, superimposed on the first tinted layer.

17. The self-adhesive label according to claim 1, wherein the extra thickness comprises pigments of the color of the glass on which the label is intended to be attached.

18. A bottle bearing a label according to claim 1 glued on its surface.

19. The bottle according to claim 18, which is made of glass having a color and wherein the extra thickness (220) of the label comprises pigments of the color of the glass of the bottle.

20. A method of manufacturing a self-adhesive label produced in relief in order to visually and/or tactilely simulate decorative molding of a material of a container or a decorative seal applied to the container, the method comprising:

a step of applying adhesive onto a first surface of a flexible plastic sheet, the flexible plastic sheet having a second surface opposite the first surface, the flexible plastic sheet having a periphery;

a step of forming, on the second surface of the flexible plastic sheet, an extra thickness comprising a flexible plastic material, the extra thickness covering the periphery of the flexible plastic sheet to thereby form a decorative design simulating an engraved relief or an edge of a seal; and a step of jointly cutting i) a periphery of the extra thickness and ii) the periphery of the flexible plastic sheet to thereby form a cut edge in the extra thickness extending between an uppermost first surface and a lowermost second surface of the extra thickness and in the flexible plastic sheet, where the cut edge of the extra thickness is formed as a continuation of the cut edge of the flexible plastic sheet up to a lower surface of the flexible plastic sheet.

21. The method according to claim 20, which comprises:

a step of presenting a laminated sheet onto a removable carrier;

a step of printing a circular molding with a varnish configured to repel a liquid plastic material being spread;

a step of half-cutting the shape of the label so as to cut only the thickness of the sheet and not that of the removable carrier;

a step during which plastic material mixed with hardener is poured outside the resin stop molding, the resin stopping when it abuts the cut; and a step of hardening the plastic material.

22. The method according to claim 20, wherein, during the step of forming an extra thickness, a digital UV ink jet printing is carried out with a UV varnish.

23. The method according to claim 20, wherein, during the step of forming an extra thickness, the extra thickness is poured then hardened.

24. A self-adhesive label produced in relief in order to visually and tactilely simulate a decorative molding of a material of a container or a decorative seal or stamp applied to the container, the self-adhesive label comprising:

a layer of adhesive;

a flexible plastic sheet having a periphery with a cut edge, a lower first surface, and an upper second surface opposite the lower first surface, the lower first surface of the flexible plastic sheet being entirely covered by the layer of adhesive; and the extra thickness having an uppermost first surface and a lowermost second surface in contact with and covering the upper second surface of the flexible plastic sheet at least at the cut edge of the flexible plastic sheet, the extra thickness being comprised of a flexible plastic material from the uppermost first surface to the lowermost second surface, the extra thickness, from the uppermost first surface to the lowermost second surface, forming a decorative design simulating an engraved relief or an edge of a seal, the extra thickness having an cut edge continuing from i) a periphery of the lowermost second surface of the extra thickness to ii) a periphery of the uppermost first surface of the extra thickness, wherein the cut edge at the periphery of the lowermost second surface of the extra thickness and the cut edge at the periphery flexible plastic sheet coincide so that the cut edge of the extra thickness is a continuation of the cut edge of the flexible plastic sheet to the lower surface of the flexible plastic sheet.

* * * * *